United States Patent [19]

Green

[11] 3,973,794

[45] Aug. 10, 1976

[54] INTERIOR DOOR LATCH ASSEMBLY

[76] Inventor: Leonard Green, 620 E. Pine St., Santa Ana, Calif. 92701

[22] Filed: Apr. 30, 1975

[21] Appl. No.: 572,959

[52] U.S. Cl. ..... 292/254
[51] Int. Cl.[2] ..... E05C 3/08
[58] Field of Search ..... 292/254, 227, 337, 226, 292/224, 221

[56] References Cited

UNITED STATES PATENTS

| | | | |
|---|---|---|---|
| 1,784,935 | 12/1930 | Johnson | 292/254 |
| 2,968,506 | 1/1961 | Lade | 292/254 X |
| 3,287,052 | 11/1966 | Wartian | 292/254 |
| 3,479,074 | 11/1969 | Schlage | 292/1 |

*Primary Examiner*—Richard E. Moore

[57] ABSTRACT

An interior door latch assembly whereby a door is held in a closed position by a spring-loaded latch keeper pivoted within its own keeper housing which is located in the door frame, the keeper being biased outwardly for latching engagement with the lip of a mating carriage housing disposed within the door along the free leading end thereof. The door is opened by slidably moving a spring-biased carriage lever which extends outwardly from both sides of the door, the lever having a pivoted arm operably coupled thereto. The pivot arm forces the spring-biased keeper beyond the lip of the carriage housing, thereby disengaging the keeper therefrom and allowing the door to open. The improved assembly is installed by cutting a V notch in the frame end of the door to receive the carriage housing, and boring a corresponding shallow cavity into the door frame wherein the keeper housing is received therein. A large drilled hole in the door is not required.

7 Claims, 5 Drawing Figures

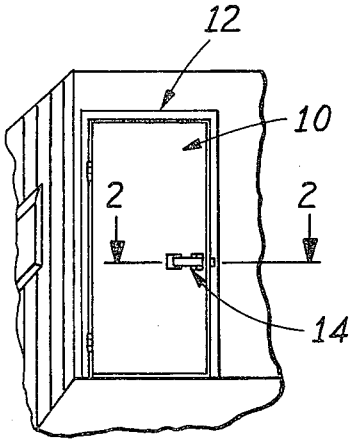
FIG. 1.
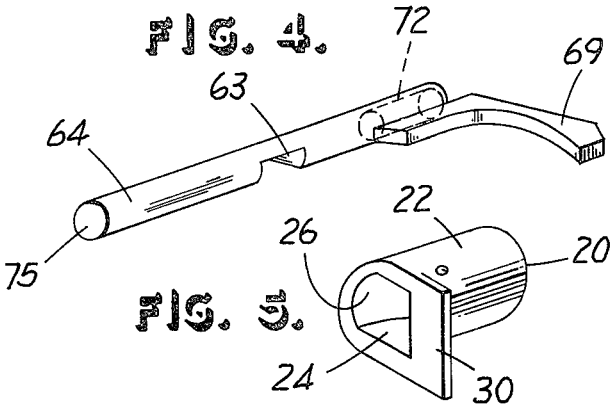
FIG. 4.
FIG. 5.
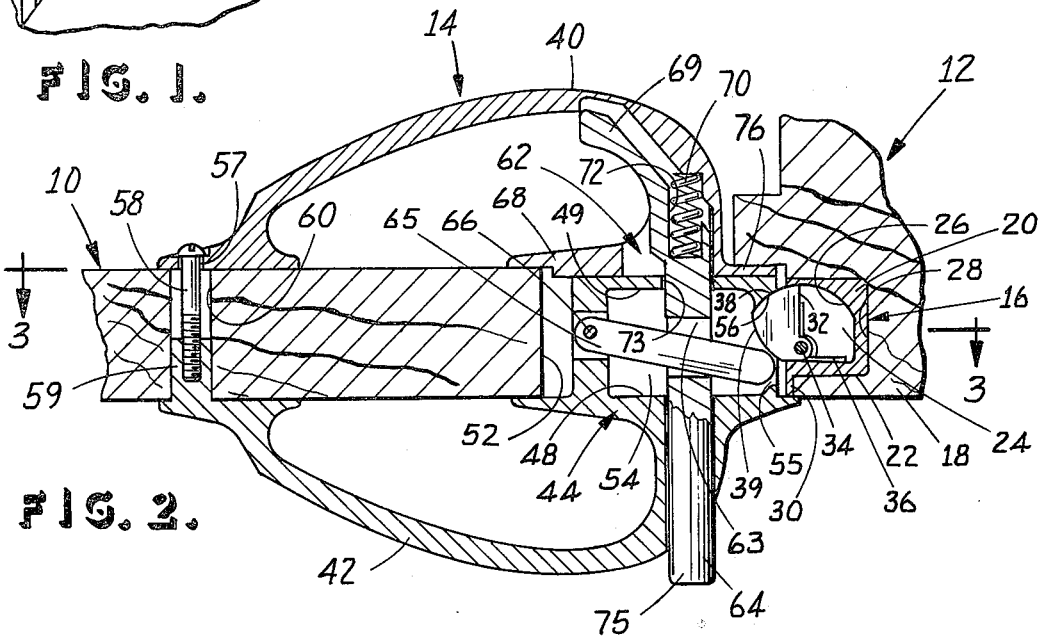
FIG. 2.
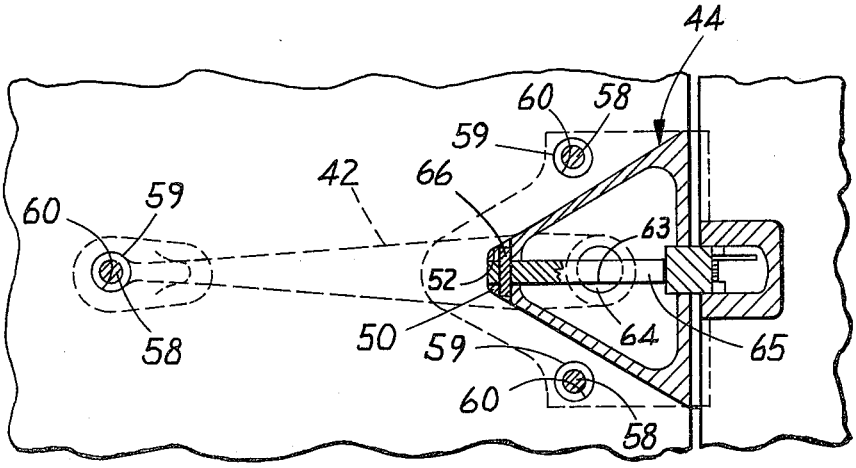
FIG. 3.

INTERIOR DOOR LATCH ASSEMBLY

BACKGROUND OF THE INVENTION

1. Field of the Invention

This invention relates generally to door latch sets and relates more particularly to an interior door latch assembly having relatively few working parts therein.

2. Description of the Prior Art

As is well known in the art, various types of door latch sets are presently available. However, several problems and difficulties are encountered in installing and maintaining these devices.

A conventional door latch set is designed to be installed by drilling a large hole through the free end of the door, cutting or gouging a slot for coacting with the bolt mechanism, and then boring or gouging an opening on the door frame opposite the bolt mechanism. A strike plate which engages the bolt in the closed position is fastened to the door frame over this opening.

To install this type of mechanism requires a considerable amount of labor, special tool of several kinds, and special skills. This results in the disadvantage that a skilled carpenter must install the latching assemblies and must take great care to determine the exact location in the door and door frame for the various holes and recesses.

Small errors result in doors that will not latch properly. Large errors result in ruined doors.

Various approaches have been taken to solve these problems. Some of them are illustrated in U.S. Pat. No. 258,431, U.S. Pat. No. 921,711, U.S. Pat. No. 2,003,731, U.S. Pat. No. 2,194,601, U.S. Pat. No. 2,617,287 and U.S. Pat. No. 3,608,939.

None of these examples of the prior art satisfactorily solve the problems of providing a low cost, simple means of installing an interior door latch whose mating parts are within the door end and the door frame.

SUMMARY OF THE INVENTION

This invention provides a door latch assembly particularly designed for interior door construction where there is no requirement for controlled egress and ingress between one room and another. Hence the present invention comprises a spring-biased latching keeper operably arranged within a keeper housing wherein the housing is formed of a hollow cup-like member having the keeper therein pivoted and biased outwardly therefrom. A single shallow bore is cut within the door jamb of the door opening wherein the keeper housing is received.

As the door is closed a striking plate which is formed as an integral part of one of the door handles engages the keeper, forcing it to retract within the hollow compartment of the housing. When the door is fully closed, the keeper is again biased outwardly, being received in the corresponding opening disposed within the carriage housing — thus abutting the lip member of the carriage housing, whereby the door is releasably secured in a closed position.

The carriage housing is integrally formed as part of one side of a handle and is removably attached to a second handle oppositely disposed thereto and having the door positioned substantially therebetween. Accordingly, the carriage housing is adapted to be received in a V-shaped notch provided along the leading free edge end of the door and opposite to the latching means. Included within the carriage housing is a spring-loaded carriage lever slidably mounted therein and extending laterally outwardly from the carriage housing. Pivotally supported in the carriage housing and operably engaging the lever, is a pivot arm positioned to directly engage the keeper when the carriage lever is activated on either side of the door. When the arm engages the keeper, it is again forced inwardly — thus disengaging the keeper from the lip of the carriage housing, allowing the door to be swung open.

OBJECTS AND ADVANTAGES OF THE INVENTION

It is an object of the present invention to provide an interior door-latch assembly that can be installed by an unskilled or semi-skilled laborer and does not require a skilled carpenter.

It is another object of this invention to provide an interior door-latch assembly that can be installed in one-half or less time than is required for conventional interior latch assemblies.

It is a further object of this invention to provide an interior door-latch assembly having substantially few moving parts.

It is still another object of this invention to provide an interior door-latch assembly wherein the mechanism thereof can be easily fabricated from inexpensive plastic materials.

It is further an object of this invention to provide an interior door-latch assembly that can be easily operated by small children and aged people.

It is still a further object of this invention to provide an interior door-latch assembly that can be installed without special tools and measurement devices.

It is still another object of the present invention to provide a device of this character having a relatively long working life, yet being simple and rugged in construction.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

DESCRIPTION OF THE DRAWINGS

Referring more particularly to the accompanying drawings, which are for illustrative purposes only:

FIG. 1 is an illustration showing the present invention mounted to a conventional interior door;

FIG. 2 is an enlarged cross-sectional view taken substantially along line 2—2 of FIG. 1;

FIG. 3 is a cross-sectional view taken substantially along line 3—3 of FIG. 2;

FIG. 4 is a perspective view of the carriage lever; and

FIG. 5 is a perspective view of the keeper housing.

DESCRIPTION OF THE PREFERRED EMBODIMENT

Referring more particularly to the drawings, there is illustrated in FIG. 1 a conventional interior door, generally indicated at 10, being supported within a typical door frame by numeral 12. Illustrated therewith and disclosed as being mounted thereto is the present invention referred to as an interior door-latch assembly, indicated generally at 14.

The interior door-latch assembly includes a latching means, designated at 16, which is mounted to the door jamb 18 of the door frame 12, and a latch releasing means which is supported separately in door 10, as seen in FIGS. 2 and 3.

The latching means comprises a keeper housing 20 formed by an outer cylindrical wall 22 defining a hollow compartment 24 having one arcuate wall 26 included therein. Said housing is adapted to be received in a shallow cavity 28 bored in the door jamb 18. Hence, the assembly requires only one simple hole to be drilled in the door jamb, said hole having the same diameter as the outer diameter of keeper housing 20.

Included as an integral part of housing 20 is a flange member 30 which extends laterally outward from the opened end of the keeper housing, as readily seen in FIGS. 2 and 5. Said flange 30 provides protection against damage to the leading edge of the jamb 18.

Operably mounted within the compartment 24 of the housing 20 is a keeper 32. The keeper is pivoted therein by pivot pin 34, the keeper being biased outwardly about pin 34 by a spring 36 so as to engage the latch-releasing means when the door is in a closed position. Said keeper includes a first arcuate edge 38 having the identical radius as the arcuate wall 26 of the housing 20, and a second arcuate edge 39 which forms the leading edge thereof and provides a striking surface.

The other portion of said door-latch assembly 14 comprises a pair of handles 40 and 42, respectively, disposed on either side of door 10, as illustrated in FIG. 1, wherein handle 42 includes an integrally formed carriage housing 44. Said carriage housing 44 is defined by walls 45, 46, 47, 48 and 49 respectively, whereby the housing is formed in a substantially triangular configuration, as shown in FIG. 3. Walls 46 and 47 converge rearwardly, terminating in an apex 50. This housing is received and supported within the leading edge of door 10 wherein the door is provided with a horizontal V-shaped notch 52, the notch having converging walls identical to those of converging walls 46 and 47, respectively. Said walls 45 through 49, in themselves, define a compartment 54 having a substantially rectangular opening 55 arranged in wall 45 and positioned in direct alignment with keeper 32, whereby keeper 32 is readily received therein when door 10 is in a closed position. An enlarged lip 56 is formed along one edge of opening 55, providing a latch abutment for engagement with edge 38 of keeper 32.

To retain the carriage housing in a proper location and secured to door 10, the handles are provided with fastening means whereby the door is disposed between the oppositely arranged handles, wherein handle 40 includes a plurality of holes 57 to receive screws 58 therethrough. Each screw 58 fastens to an extended threaded boss 59, as seen in FIGS. 2 and 3. Both the bosses 59 and the screws 58 are adapted to be mounted in holes 60 arranged in the configuration as seen in FIG. 3.

At the time handles 40 and 42 are secured to door 10, the assembly includes a latch-releasing means, indicated generally at 62, said means being located in the handles 40 and 42, respectively, and operable within compartment 54 of carriage housing 44. Latch releasing means comprises a carriage lever 64 slidably supported within both handles 40 and 42, having its central body portion located within compartment 54. The central body portion of the lever includes an aperture 63 through which a release arm 65 passes. The arm 65 is pivoted by pin 66 fixed in the apex 50 of the carriage housing 44, the apex being provided with a rectangular opening 67 in which one end of arm 65 is received. The arm 65 extends outwardly therefrom through aperture 63 to a point where the free end of the arm is adjacent the opening 55 in the face of wall 45, whereby engagement with keeper 32 along its leading edge 39 is readily established.

Accordingly, any sliding movement of lever 64 causes arm 65 to move in an arc about pin 66. The free end of said arm 65 contacts keeper 32, forcing it back within compartment 24 of keeper housing 20 — thus disengaging keeper 32 form lip 56. The door 10 is then allowed to open.

Carriage lever is spring biased to hold arm 65 in the position shown in FIG. 2 and, when it is necessary to release keeper 32 from the latch position, lever 64 is moved laterally within the handles. Handle 40 includes an integral base plate 68 having a slot 67 therein to accommodate one end of the lever carriage 64. This particular end is formed with a trigger extension 69 adapted to be received in slot 67. Said trigger end is also adapted to receive a spring 70 by means of a bore 72, the spring thus providing the biasing action needed to position arm 65 as shown. The lever 64 passes through hole 73 in wall 49 and extends through passage 74 disposed in handle 42. The lever terminates just beyond the handle 42, providing a button-like arrangement. Therefore, to unlatch the door you must pull trigger 69 located in handle 40 positioned on one side of the door or push the button 75 in handle 42 positioned on the opposite side of the door.

However, in closing door 10 a striking plate 76 formed as part of the base plate 68 of the handle 40 strikes the keeper 32 along surface 39, forcing said keeper inwardly until opening 55 of the carriage housing is aligned therewith, at which time said keeper latches therein.

The invention and its attendant advantages will be understood from the foregoing description and it will be apparent that various changes may be made in the form, construction and arrangement of the parts of the invention without departing from the spirit and scope thereof or sacrificing its material advantages, the arrangement herein before described being merely by way of example, and I do not wish to be restricted to the specific form shown or uses mentioned, except as defined in the accompanying claims.

I claim:

1. A door latch assembly comprising:

a pair of oppositely disposed handles having a door positioned therebetween, said door including a notch along the leading edge thereof;

a carriage housing formed integrally as part of one of said handles, and adapted to be removably mounted in said notch of said door, said housing defining a compartment therein and having a latch opening arranged therein;

a latch assembly mounted in a door jamb for direct latching engagement with said carriage housing to retain said door in a closed position, wherein said latching assembly comprises:

a keeper housing having a compartment formed therein;

a keeper mounted within said compartment of said keeper housing for arcuate movement therein; and means for biasing said keeper outwardly from said compartment thereof, said keeper being disposed within said housing; and latch-releasing means operably mounted in said carriage housing; wherein said latch releasing means comprises:

a carriage lever extending laterally through said carriage housing and projecting outwardly on either side of said door, said projections thereof being movably supported in respective handles;

a spring-biasing means positioned between one end of said lever and adjacent handle; and a latch-releasing arm movably mounted within said compartment of said carriage housing, having one end thereof pivotally connected to said housing and the opposite free end thereof terminating adjacent said latch opening in said housing for direct engagement with said keeper, when said keeper is to be disengaged from said carriage housing, whereby said door is allowed to open said arm being operably coupled to said carriage lever.

2. A door-latch assembly as recited in claim 1, wherein said carriage lever includes:

a trigger member formed as an integral part of said lever adjacent the biased end thereof, the opposite end of said lever being formed as a button, and wherein an aperture is centrally disposed within said lever whereby said latch-releasing arm passes therethrough for movable operation therewith.

3. A door-latch assembly as recited in claim 2, wherein said keeper includes:

a first arcuate edge arranged for direct latching abutment with one side of said opening in said carriage housing whereby said door is held in a closed position until said first edge is disengaged from said opening; and a second arcuate edge arranged to be engaged by said free end of said latch-release arm when said door is to be opened.

4. A door-latch assembly as recited in claim 3, wherein means is included for removably fastening said handles to said door.

5. A door-latch assembly as recited in claim 3, wherein said notch in said edge of said door is formed in a substantially V-shaped configuration, and wherein said carriage housing is formed in a triangular configuration, whereby said carriage housing conforms to said V-shaped notch for mounting reception therein.

6. A door-latch assembly as recited in claim 5, wherein said keeper housing comprises:

an annular, outer wall housing defining a shallow compartment therein, said compartment having an arcuate inner wall adjacent said first arcuate wall of said keeper wherein said arcs of each are identical, whereby said keeper is readily received therein during opening of said door.

7. A door-latch assembly as recited in claim 6 wherein one of said handles includes a base member having a striking plate for engagement with said second arcuate edge of said keeper when said door is being moved to a closed position, whereby said keeper is forced within said compartment of said keeper housing.

* * * * *